US008554121B2

(12) United States Patent
Iikura

(10) Patent No.: US 8,554,121 B2
(45) Date of Patent: Oct. 8, 2013

(54) BELT DRIVING UNIT AND IMAGE FORMING APPARATUS

(75) Inventor: Takayuki Iikura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 13/308,720

(22) Filed: Dec. 1, 2011

(65) Prior Publication Data

US 2012/0141172 A1 Jun. 7, 2012

(30) Foreign Application Priority Data

Dec. 7, 2010 (JP) ..... 2010-272698

(51) Int. Cl.
*G03G 15/01* (2006.01)

(52) U.S. Cl.
USPC ..... 399/302; 399/395

(58) Field of Classification Search
USPC ..... 399/301, 302, 388, 394, 395, 396
See application file for complete search history.

(56) References Cited

U.S. PATENT DOCUMENTS

2009/0304417 A1* 12/2009 Inoue ..... 399/301
2010/0272478 A1* 10/2010 Ichihashi ..... 399/299

FOREIGN PATENT DOCUMENTS

JP 2006-030711 A 2/2006
JP 2009-282196 A 12/2009

* cited by examiner

*Primary Examiner* — Hoang Ngo
(74) *Attorney, Agent, or Firm* — Canon USA Inc IP Division

(57) ABSTRACT

Provided is a belt driving unit including a plurality of rollers including a driving roller; an endless belt stretched round the rollers; a driving unit that conveys the endless belt by driving the driving roller; a control unit that controls the driving of the driving roller; and a detection unit that detects the position of the endless belt in a widthwise direction perpendicular to the conveying direction of the endless belt. The driving roller includes a first driving roller and a second driving roller. A direction in which the first driving roller forwards the endless belt and a direction in which the second driving roller forwards the endless belt are nonparallel. The control unit controls the position of the endless belt in the widthwise direction by driving the first driving roller and the second driving roller at different speeds on the basis of the detection result of the detection unit.

5 Claims, 4 Drawing Sheets

BELT DRIVING UNIT AND IMAGE FORMING APPARATUS

BACKGROUND OF THE INVENTION

1. Field of the Invention

One of the aspects of the present invention relates to a belt driving unit that corrects a skew of an endless belt stretched around a plurality of supporting members and to an image forming apparatus including the same.

2. Description of the Related Art

Known image forming apparatuses in the related art are equipped with endless belts, such as an intermediate transfer belt, a fixing belt, and a recording-paper conveying belt, and a belt driving unit for driving such endless belts. The belt driving unit drives the endless belts. Each endless belt is supported by a driving roller and a driven roller, which is rotationally driven by the driving roller.

Ideally, the endless belts are conveyed without skewing in a direction perpendicular to a direction in which the endless belts are conveyed (i.e., a widthwise direction). However, it is known that the endless belts are skewed in the widthwise direction and meander due to various causes, such as the inclinations of the rollers, a difference in tension between the right and left of the endless belts, and external load fluctuations. One example of a technology for correcting the meandering of the endless belts is a technology of inclining a steering roller (for example, refer to Japanese Patent Laid-Open No. 2009-282196).

However, the technology disclosed in Japanese Patent Laid-Open No. 2009-282196 has a problem in that it requires a configuration for inclining the steering roller, which increases the size and cost of the apparatus.

Thus, a technology for correcting the meandering of the endless belts by stretching the endless belts round a plurality of separate driving rollers disposed on the same axis and separately controlling the rotational speeds of the individual rollers has been proposed (for example, refer to Japanese Patent Laid-Open No. 2006-030711).

However, it is difficult for the technology disclosed in Japanese Patent Laid-Open No. 2006-030711 to apply sufficient forces in the widthwise direction of the endless belts even if the plurality of separate driving rollers are driven at different speeds. Therefore, a sufficient widthwise skewing force cannot be applied to the endless belts, and thus, it is difficult to correct the meandering of the endless belts only with this configuration.

SUMMARY OF THE INVENTION

One of the aspects of the present invention provides a belt driving unit in which a sufficient widthwise skewing force can be applied to endless belts with a simple configuration in controlling the skew correction of the endless belts, and an image forming apparatus including the same.

Another aspect of the invention provides a belt driving unit according to a first aspect of the present invention includes a plurality of rollers including a driving roller that is rotationally driven; an endless belt stretched round the plurality of rollers; a driving unit that conveys the endless belt by rotating the driving roller; a control unit that controls the driving of the driving roller by the driving unit; and a detection unit that detects the position of the endless belt in a widthwise direction that is perpendicular to a conveying direction of the endless belt, wherein the driving roller includes a first driving roller and a second driving roller arranged side by side in the widthwise direction; a direction in which the first driving roller forwards the endless belt and a direction in which the second driving roller forwards the endless belt are nonparallel to each other; and the control unit controls the position of the endless belt in the widthwise direction by driving the first driving roller and the second driving roller at different speeds on the basis of a detection result of the detection unit.

Another aspect of the invention provides an image forming apparatus according to a second aspect of the present invention includes the belt driving unit according to the first aspect and forms a toner image on recording paper, wherein the endless belt is an intermediate transfer belt to which a toner image is transferred from a photosensitive member on the surface of which the toner image is formed, a fixing belt provided in a fixing unit that fixes the toner image transferred onto the recording paper by heating, or a recording-paper conveying belt that conveys the recording paper.

Further features of the present invention will become apparent from the following description of exemplary embodiments with reference to the attached drawings.

DESCRIPTION OF THE EMBODIMENTS

Figure 1:
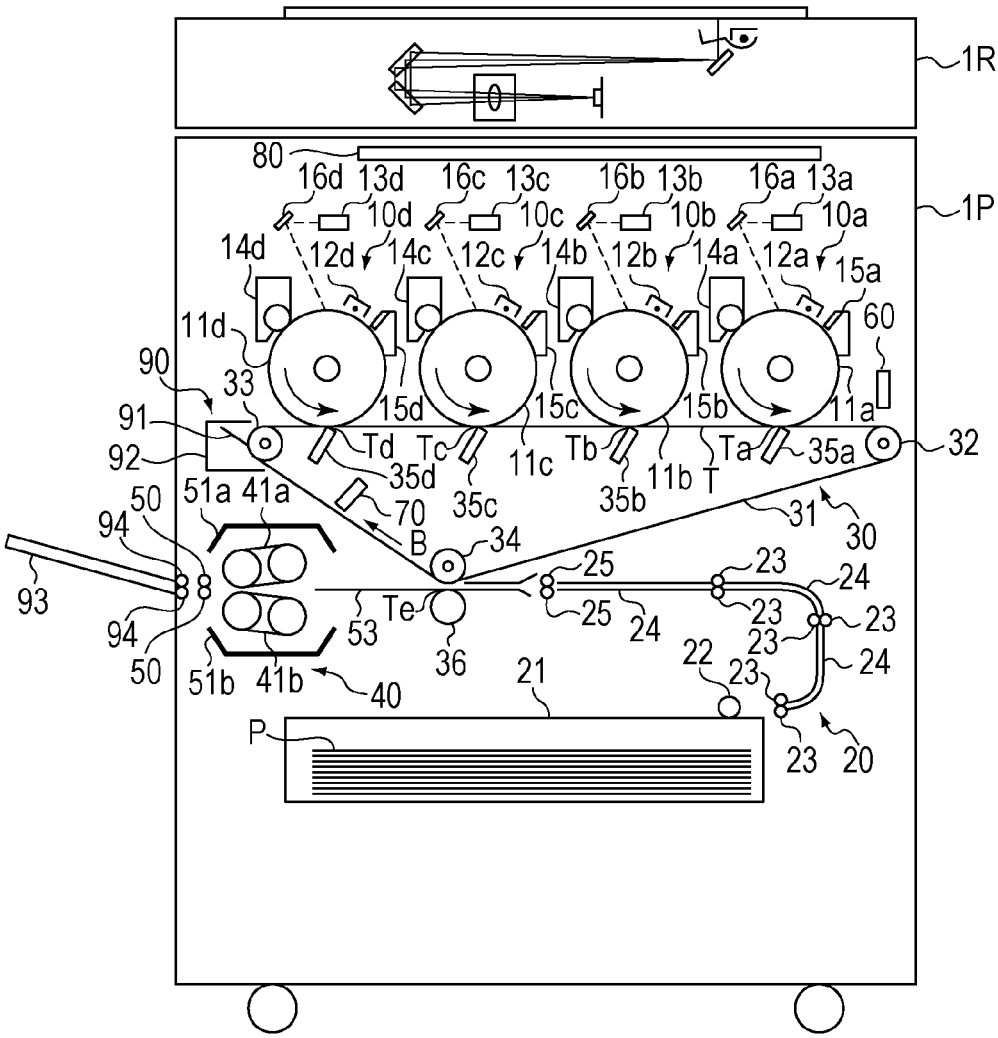
FIG. 1 is a longitudinal sectional view showing, in outline, the overall configuration of an image forming apparatus according to an embodiment of the present invention.

FIG. 1 is a longitudinal sectional view showing, in outline, the overall configuration of an image forming apparatus according to an embodiment of the present invention.

The image forming apparatus according to this embodiment is a color image forming apparatus in which a plurality of image forming units are arranged in a line and which employs an intermediate transfer system.

The image forming apparatus includes an image reading unit 1R and an image output unit 1P. The image reading unit 1R optically reads a document image, converts the image to an electrical signal, and transmits the signal to the image output unit 1P. The image output unit 1P includes four image forming units 10*a*, 10*b*, 10*c*, and 10*d* arranged in a line, a paper feeding unit 20, an intermediate transfer unit 30, a fixing unit 40, a cleaning unit 90, a photosensor 60, and a control unit 80.

The individual image forming units 10*a* to 10*d* have the same configuration. In the image forming units 10*a* to 10*d*, drum-like photosensitive members, that is, photosensitive drums 11*a*, 11*b*, 11*c*, and 11*d*, are each supported rotatably about a shaft and are rotationally driven in the direction of the arrow. Primary chargers 12*a* to 12*d*, optical systems 13*a* to 13*d*, mirrors 16*a* to 16*d*, developing units 14*a* to 14*d*, and cleaning devices 15*a* to 15*d* are disposed to face the outer peripheral surfaces of the photosensitive drums 11*a* to 11*d*, respectively, in the rotating direction.

The primary chargers 12*a* to 12*d* apply a uniform electrical charge onto the surfaces of the photosensitive drums 11*a* to 11*d*. Next, light beams, such as laser beams, modulated by the optical systems 13*a* to 13*d* in response to a recording image signal from the image reading unit 1R irradiate the photosensitive drums 11*a* to 11*d* via the mirrors 16*a* to 16*d* so that the photosensitive drums 11*a* to 11*d* are exposed to the light, respectively. Thus, electrostatic latent images are formed on the photosensitive drums 11*a* to 11*d*.

Furthermore, the electrostatic latent images are developed by the developing units 14*a* to 14*d* that accommodate four color developers (hereinafter referred to as toners), yellow, cyan, magenta, and black, respectively. The developed visible images are transferred to an intermediate transfer belt 31, which constitutes the intermediate transfer unit 30, in image transfer areas Ta, Tb, Tc, and Td, respectively.

The cleaning devices 15*a* to 15*d* scrape toners that are left on the photosensitive drums 11*a* to 11*d* without being transferred onto the intermediate transfer belt 31 at the downstream side of the image transfer areas Ta to Td to clean the surface of the photosensitive drums 11*a* to 11*d*. By the process described above, image formation with the toners is performed in sequence.

The paper feeding unit 20 includes a cassette 21 for accommodating recording paper P, a pickup roller 22 for picking up the recording paper P from the cassette 21 one by one, paper feed roller pairs 23, a paper feed guide 24, and a registration roller pair 25. The paper feed roller pairs 23 are roller pairs for conveying the recording paper P picked up from the pickup roller 22. The registration roller pair 25 is a roller pair for forwarding the recording paper P to a secondary transfer area Te in synchronization with the timing at which the individual image forming units 10*a* to 10*d* form images.

Next, the intermediate transfer unit 30 will be described in detail.

The intermediate transfer belt 31 is stretched round a driving roller 32 that transmits a driving force to the intermediate transfer belt 31, a driven roller 33, and a secondary transfer facing roller 34. The driven roller 33 is a roller that follows the rotation of the intermediate transfer belt 31 as a tension roller that gives proper tension to the intermediate transfer belt 31 using the urge of a spring (not shown). A primary transfer plane T is formed between the driving roller 32 and the driven roller 33.

The intermediate transfer belt 31 is formed of, for example, polyethylene terephthalate (PET) or polyvinylidene fluoride (PVdF). The driving roller 32 is formed of a metal roller coated with rubber (urethane or chloroprene) several millimeters in thickness to prevent slipping on the intermediate transfer belt 31. The driving roller 32 is rotationally driven by a pulse motor (not shown).

Primary transfer chargers 35*a*, 35*b*, 35*c*, and 35*d* are disposed, on the back of the intermediate transfer belt 31, in the image transfer areas Ta to Td at which the photosensitive drums 11*a* to 11*d* and the intermediate transfer belt 31 face, respectively. On the other hand, a secondary transfer roller 36 is disposed facing the secondary transfer facing roller 34 to form the secondary transfer area Te, that is, the nip between it and the intermediate transfer belt 31. The secondary transfer roller 36 may be pressed against the intermediate transfer belt 31 under an appropriate pressure.

The cleaning unit 90 for cleaning the image formed surface of the intermediate transfer belt 31 in this embodiment is disposed downstream of the secondary transfer area Te of the intermediate transfer belt 31. The cleaning unit 90 may comprise a cleaning blade 91 for removing the toner on the intermediate transfer belt 31 and a waste toner box 92 for accommodating the waste toner.

The fixing unit 40 includes an upper belt unit 41*a* accommodating a heat source, such as a halogen lamp heater, and a lower belt unit 41*b* pressed against the upper belt unit 41*a*. The upper belt unit 41*a* and the lower belt unit 41*b* can be spaced away from each other by a detachable motor (not shown). The lower belt unit 41*b* is also sometimes provided with a heat source.

The fixing unit 40 further includes a conveying guide 53 for guiding the recording paper P to the nip portion between the upper and lower belt units 41*a* and 41*b* and upper and lower covers 51*a* and 51*b* for preventing the heat of the fixing unit 40 from radiating outwards. The fixing unit 40 further includes an inner eject roller pair 50 and an outer eject roller pair 94 for guiding the recording paper P discharged from the upper and lower belt units 41*a* and 41*b* to the exterior of the apparatus; and a paper output tray 93 in which the recording paper P is to be stacked. The fixing unit 40 fixes images on the recording paper P with heat while nipping the recording paper P at the nip portion.

Next, the operation of the image forming apparatus will be described.

When an image-forming-operation start signal is issued by a CPU 81 (see FIG. 3) in the control unit 80, a paper feeding operation of feeding the recording paper P from the paper feeding unit 20 according to the recording paper size selected by the user is started. For example, in FIG. 1, first, the recording paper P is picked up from the cassette 21 one by one by the pickup roller 22.

The recording paper P is guided through the paper feed guide 24 by the paper feed roller pairs 23 and is conveyed to the registration roller pair 25. At that time, the rotational driving of the registration roller pair 25 is at rest, so that the distal end of the recording paper P comes into contact with the nip portion therebetween. Thereafter, the registration roller pair 25 starts to rotate in synchronization with the timing at which the image forming units 10*a* to 10*d* start image formation. The timing is set so that the recording paper P and toner images that are primarily transferred onto the intermediate transfer belt 31 by the image forming units 10*a* to 10*d* coincide in the secondary transfer area Te.

On the other hand, when the image-forming-operation start signal is issued, a toner image formed, by the process, on the photosensitive drum 11*d* at the uppermost stream in the rotating direction of the intermediate transfer belt 31 is transferred onto the intermediate transfer belt 31 in the primary transfer area Td by the primary transfer charger 35*d*. The transferred toner image is conveyed to the next primary transfer area Tc, where image formation is performed with a delay corresponding to the time the toner image is conveyed between the image forming units 10*d* and 10*c*, and the next toner image is transferred with the previous image in register.

The same process is repeated thereafter, so that four color toner images are finally transferred onto the intermediate transfer belt 31. Thereafter, when the recording paper P enters the secondary transfer area Te, where it comes into contact with the intermediate transfer belt 31, a high voltage is applied to the secondary transfer roller 36 in synchronization with the timing when the recording paper P passes. Thus, the four color toner images that are formed on the intermediate transfer belt 31 by the foregoing process are transferred onto the surface of the recording paper P.

Next, the recording paper P is accurately guided to the nip portion between the upper belt unit 41*a* and the lower belt unit 41*b* by the conveying guide 53. The toner images are fixed onto the surface of the recording paper P by the heat of the upper belt unit 41*a* and the lower belt unit 41*b* and the pressure of the nip. Thereafter, the recording paper P is conveyed by the inner eject roller pair 50 and the outer eject roller pair 94 outside the apparatus and is stacked in the paper output tray 93.

Figure 2:
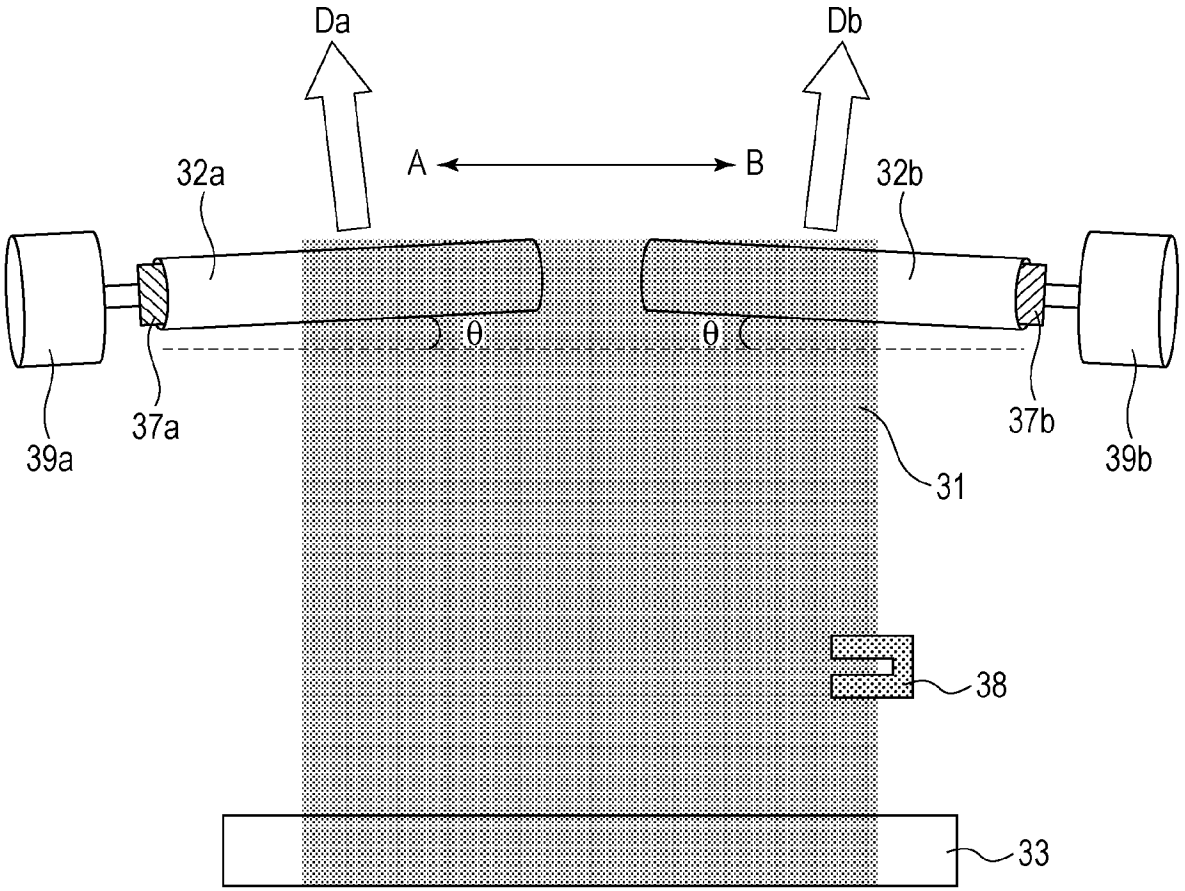
FIG. 2 is a diagram showing the drive configuration of an intermediate transfer belt.

FIG. 2 is a diagram showing the drive configuration of the intermediate transfer belt 31.

The driving roller 32 for driving the intermediate transfer belt 31 is composed of a first driving roller 32*a* and a second driving roller 32*b*. The shaft of the first driving roller 32*a* is provided with a first speed sensor 37*a* for detecting the rotating speed of the first driving roller 32*a*. The shaft of the second driving roller 32*b* is provided with a second speed sensor 37*b* for detecting the rotating speed of the second driving roller 32*b*. The speed sensors 37*a* and the 37*b* are constituted by rotary encoders.

A first motor 39*a* is a motor for driving the first driving roller 32*a*. A second motor 39*b* is a motor for driving the second driving roller 32*b*. The driven roller 33 is rotated by the rotation of the intermediate transfer belt 31.

The widthwise position (skew) of the intermediate transfer belt 31 is detected by a skew sensor 38 in which a plurality of light emitting portions and photo detectors are arranged in a direction perpendicular to the conveying direction of the intermediate transfer belt 31. The deviation of the intermediate transfer belt 31 from a datum point is detected as a skew on the basis of the detection result of the skew sensor 38. The speeds of the first driving roller 32*a* and the second driving roller 32*b* are controlled on the basis of the skew. The control unit 80 also controls the rotational speed of the first driving roller 32*a* and the second driving roller 32*b*.

The driving rollers 32*a* and 32*b* are disposed so that the forwarding direction Da of the intermediate transfer belt 31 by the first driving roller 32*a* and the forwarding direction Db of the intermediate transfer belt 31 by the second driving roller 32*b* become nonparallel. As shown in FIG. 2, the shafts of the driving rollers 32*a* and 32*b* are inclined at angle θ with respect to the direction (widthwise direction) perpendicular to the conveying direction of the intermediate transfer belt 31. The first driving roller 32*a* and the second driving roller 32*b* are angled to generate a force that conveys the intermediate transfer belt 31 and an outward skewing force (skewing force) with respect to the driving roller shafts.

If the rotating speed Vb of the second driving roller 32*b* is made higher than the rotating speed Va of the first driving roller 32*a*, the skewing force of the second driving roller 32*b* becomes larger than the skewing force of the first driving roller 32*a*. This causes the intermediate transfer belt 31 to skew in the direction of B in FIG. 2. In contrast, if the rotating speed Va is made higher than the rotating speed Vb, the skewing force of the first driving roller 32*a* becomes larger than the skewing force of the second driving roller 32*b*, and thus, the intermediate transfer belt 31 skews in the direction of A in FIG. 2.

In this embodiment, the sheet conveying speed (processing speed) of the intermediate transfer belt 31 is set to 246 mm/s. When the intermediate transfer belt 31 skews in the direction of A in FIG. 2, the first driving roller 32*a* is rotated at 244 mm/s, and the second driving roller 32*b* is rotated at 246 mm/s. On the other hand, when the intermediate transfer belt 31 skews in the direction of B in FIG. 2, the first driving roller 32*a* is rotated at 246 mm/s, and the second driving roller 32*b* is rotated at 244 mm/s. When the intermediate transfer belt 31 does not skew in either direction, both of the first driving roller 32*a* and the second driving roller 32*b* are driven at 246 mm/s.

By driving the first driving roller 32*a* and the second driving roller 32*b* at different speeds, a widthwise skewing force can be generated in the intermediate transfer belt 31, thereby allowing the meandering of the intermediate transfer belt 31 to be corrected.

Figure 3:
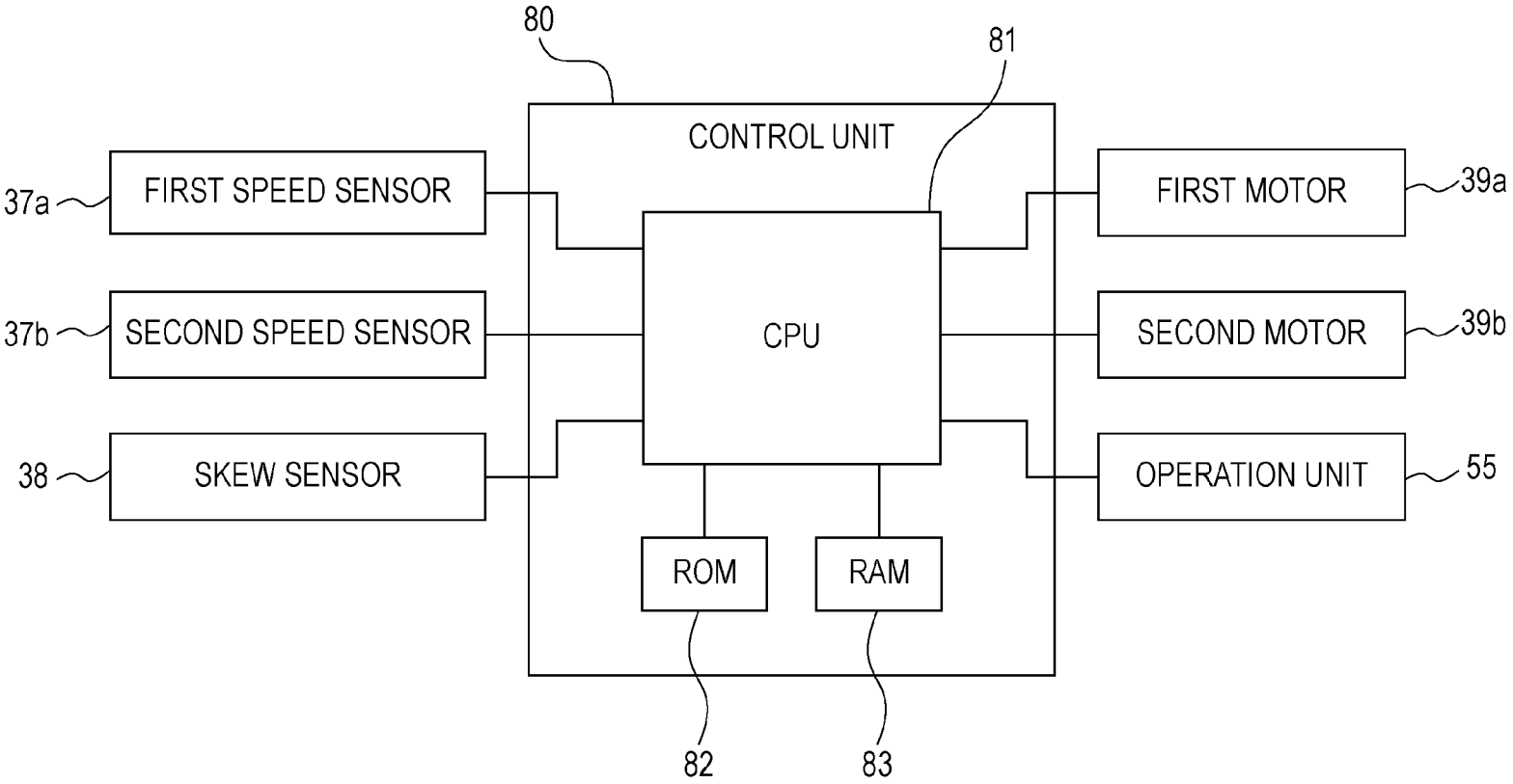
FIG. 3 is a block diagram of an image forming apparatus.

FIG. 3 is a block diagram of the image forming apparatus.

The control unit 80 includes the CPU 81, a ROM 82, and a RAM 83. The CPU 81 is a control unit that controls the entire image forming apparatus. The ROM 82 stores a control program for controlling various processes executed by the image forming apparatus. The RAM 83 is a system work memory for the CPU 81 to operate and also functions as an image memory for temporarily storing image data. The operation unit 55 is provided with various keys and a touch panel display for the user to input operations to the image forming apparatus.

The CPU 81 controls the first motor 39*a* and the second motor 39*b* on the basis of signals received from the first speed sensor 37*a*, the second speed sensor 37*b*, and the skew sensor 38.

Figure 4:
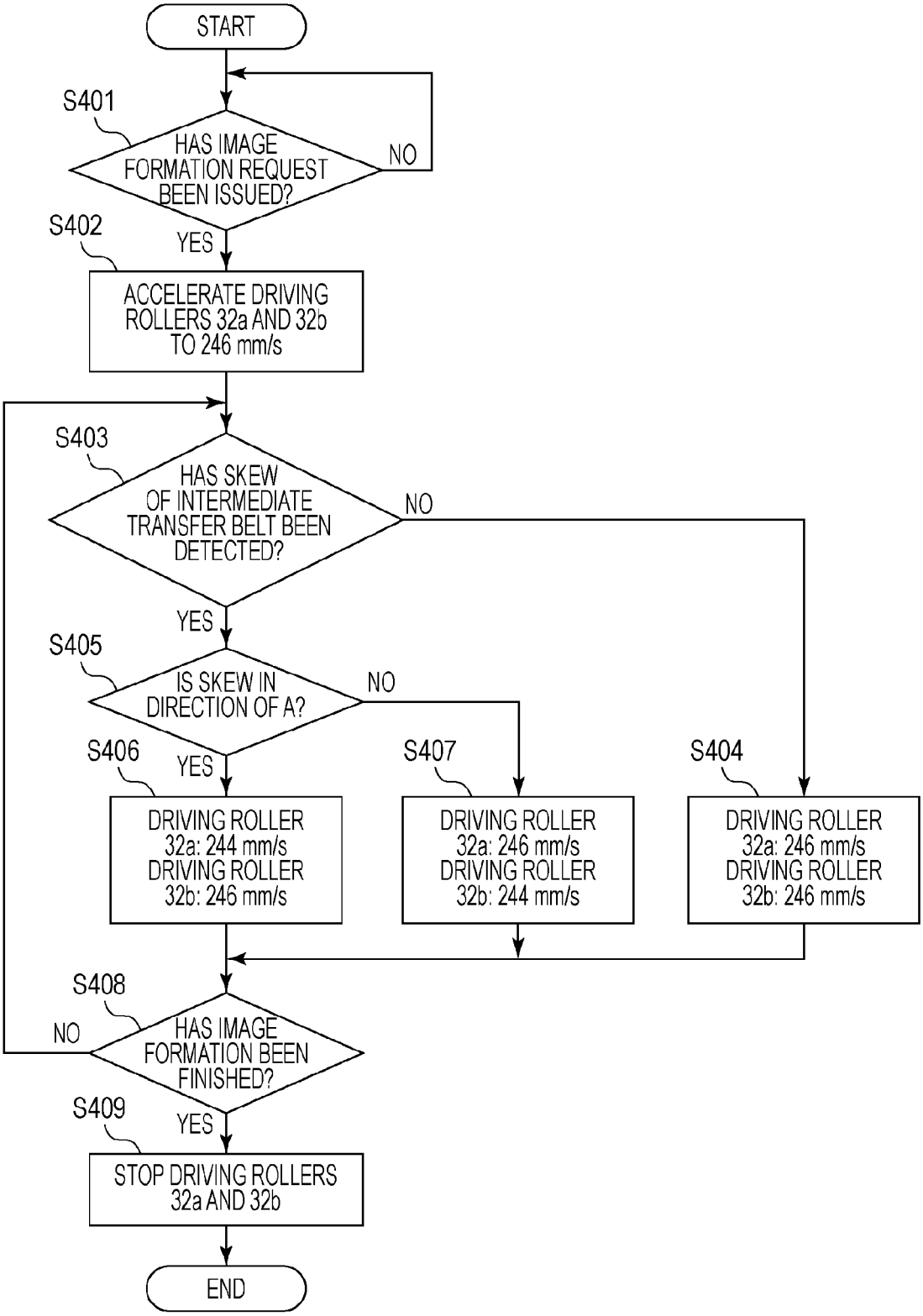
FIG. 4 is a flowchart showing meandering correction control for the intermediate transfer belt during an image forming operation.

FIG. 4 is a flowchart showing meandering correction control for the intermediate transfer belt during an image forming operation.

A program for executing this flowchart is stored in the ROM 82 and is executed by being read by the CPU 81.

First, the CPU 81 determines whether an image formation request has been issued by the user pressing a start key on the operation unit 55 (S401). If an image formation request has been issued, the CPU 81 drives the first motor 39*a* and the second motor 39*b* to accelerate the rotating speeds of the first driving roller 32*a* and the second driving roller 32*b* to 246 mm/s (S402). Control of the rotating speeds of the first driving roller 32*a* and the second driving roller 32*b* is executed with reference to detection signals from the first speed sensor 37*a* and the second speed sensor 37*b*, respectively.

Next, the CPU 81 determines whether the skew of the intermediate transfer belt 31 has occurred on the basis of the output of the skew sensor 38 (S403). If no skew has occurred in the intermediate transfer belt 31, the CPU 81 sets the rotating speeds of the first driving roller 32*a* and the second driving roller 32*b* to 246 mm/s and drives the first motor 39*a* and the second motor 39*b* at the set speeds (S404).

In step S403, if it is determined that a skew has occurred in the intermediate transfer belt 31, the CPU 81 determines whether the skew is in the direction of A in FIG. 2 on the basis of the output from the skew sensor 38 (S405). If it is a skew in the direction of A, the CPU 81 sets the rotating speed of the first driving roller 32*a* to 244 mm/s, and the rotating speed of the second driving roller 32*b* to 246 mm/s and drives the first motor 39*a* and the second motor 39*b* at the set speeds (S406).

On the other hand, if it is a skew in the direction of B, the CPU 81 sets the rotating speed of the first driving roller 32*a* to 246 mm/s, and the rotating speed of the second driving roller 32*b* to 244 mm/s and drives the first motor 39*a* and the second motor 39*b* at the set speeds (S407).

After the rotating speeds of the driving rollers 32*a* and 32*b* are set in steps S404, S406, and S407, the CPU 81 determines whether to finish the image forming operation (S408). If image formation of the last page is completed, the CPU 81 determines to finish the image forming operation.

In step S408, if it is determined that the image forming operation is not to be finished, the process returns to the step S403 described above. If it is determined that the image forming operation is to be finished, the CPU 81 stops the driving of the first motor 39*a* and the second motor 39*b* to stop the rotations of the first driving roller 32*a* and the second driving roller 32*b* (S409) to complete the flow.

Although the foregoing description takes the intermediate transfer belt as an example of the endless belts, the similar meandering correction control may be performed on the other belts provided in the image forming apparatus, such as a fixing belt and a recording-paper conveying belt. In this case, the driving of any endless belt may be controlled by the control unit 80 serving as a belt driving unit.

The present invention is not only configured such that the shaft of the first driving roller 32*a* and the shaft of the second driving roller 32*b* are nonparallel but may also be configured such that the first driving roller 32*a* and the second driving roller 32*b* have a truncated cone shape. Since the driving rollers 32*a* and 32*b* have a truncated cone shape to make the forwarding direction of the intermediate transfer belt 31 by the driving rollers 32*a* and 32*b* nonparallel, the same advantages can be achieved.

As described above, this embodiment allows meandering correction control of an endless belt with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-272698, filed on Dec. 7, 2010, which is hereby incorporated by reference herein in its entirety.

What is claimed is:

1. A belt driving unit comprising:

a plurality of rollers including a driving roller that is rotationally driven;

an endless belt stretched round the plurality of rollers;

a driving unit that conveys the endless belt by rotating the driving roller;

a control unit that controls driving of the driving roller by the driving unit; and a detection unit that detects the position of the endless belt in a widthwise direction that is perpendicular to a conveying direction of the endless belt, wherein the driving roller includes a first driving roller and a second driving roller arranged side by side in the widthwise direction;

a direction in which the first driving roller forwards the endless belt and a direction in which the second driving roller forwards the endless belt are nonparallel to each other; and the control unit controls the position of the endless belt in the widthwise direction by driving the first driving roller and the second driving roller at different speeds on the basis of a detection result of the detection unit.

2. The belt driving unit according to claim 1, wherein the control unit determines a skewing direction of the endless belt on the basis of the detection result of the detection unit and decreases the rotating speed of one of the first driving roller and the second driving roller, located at the side to which the endless belt skews to thereby correct the skew of the endless belt.

3. The belt driving unit according to claim 1, wherein the shaft of the first driving roller and the shaft of the second driving roller are nonparallel to each other.

4. The belt driving unit according to claim 1, wherein the first driving roller and the second driving roller each have a truncated cone shape.

5. An image forming apparatus including the belt driving unit according to claim 1 and forming a toner image on recording paper, wherein the endless belt is an intermediate transfer belt to which a toner image is transferred from a photosensitive member on the surface of which the toner image is formed, a fixing belt provided in a fixing unit that fixes the toner image transferred onto the recording paper by heating, or a recording-paper conveying belt that conveys the recording paper.

* * * * *